United States Patent [19]

Peter et al.

[11] 4,419,924

[45] Dec. 13, 1983

[54] BRAKE ASSEMBLY FOR FLUID OPERATED PISTON AND CYLINDER DEVICE

[76] Inventors: Oskar Peter, Frauenstein 26, D 7481 Bingen; Anton Stahr, Zellerhornstr. 22, D800 Munich, 900, both of Fed. Rep. of Germany

[21] Appl. No.: 204,835

[22] Filed: Nov. 7, 1980

[30] Foreign Application Priority Data

Nov. 8, 1979 [DE] Fed. Rep. of Germany ..... 2945133

[51] Int. Cl.[3] ..... F15B 15/26

[52] U.S. Cl. ..... 92/27; 74/531; 92/88; 188/67; 188/170

[58] Field of Search ..... 188/67, 170; 74/531; 92/24, 27, 28, 88, 137

[56] References Cited

U.S. PATENT DOCUMENTS

| | | | |
|---|---|---|---|
| 2,089,202 | 8/1937 | Gartin | 92/88 X |
| 2,394,785 | 2/1946 | Kindervater | 92/28 |
| 3,203,513 | 8/1965 | Atler | 188/170 |
| 3,251,278 | 5/1966 | Royster | 92/24 X |
| 3,893,378 | 7/1975 | Hewitt | 92/88 |
| 4,030,579 | 6/1977 | Sell | 188/67 X |
| 4,185,539 | 1/1980 | Stratienko | 92/24 X |

FOREIGN PATENT DOCUMENTS

| | | | |
|---|---|---|---|
| 923412 | 2/1955 | Fed. Rep. of Germany | 92/24 |
| 500259 | 2/1939 | United Kingdom | 248/355 |

*Primary Examiner*—George E. A. Halvosa
*Attorney, Agent, or Firm*—Kane, Dalsimer, Kane, Sullivan and Kurucz

[57] ABSTRACT

A brake assembly is provided for a fluid operated piston and cylinder device having a force applying cross head operating through a slot in the cylinder wall. The brake assembly is integrated with the cross head and consists of brake lining concentrically arranged about the cylinder for engagement with the outer surface of the cylinder. The brake assembly is actuated by a drive mechanism to engage the cylinder outer surface so as to stop, lock and/or position the piston as required.

10 Claims, 8 Drawing Figures

Fig. 7
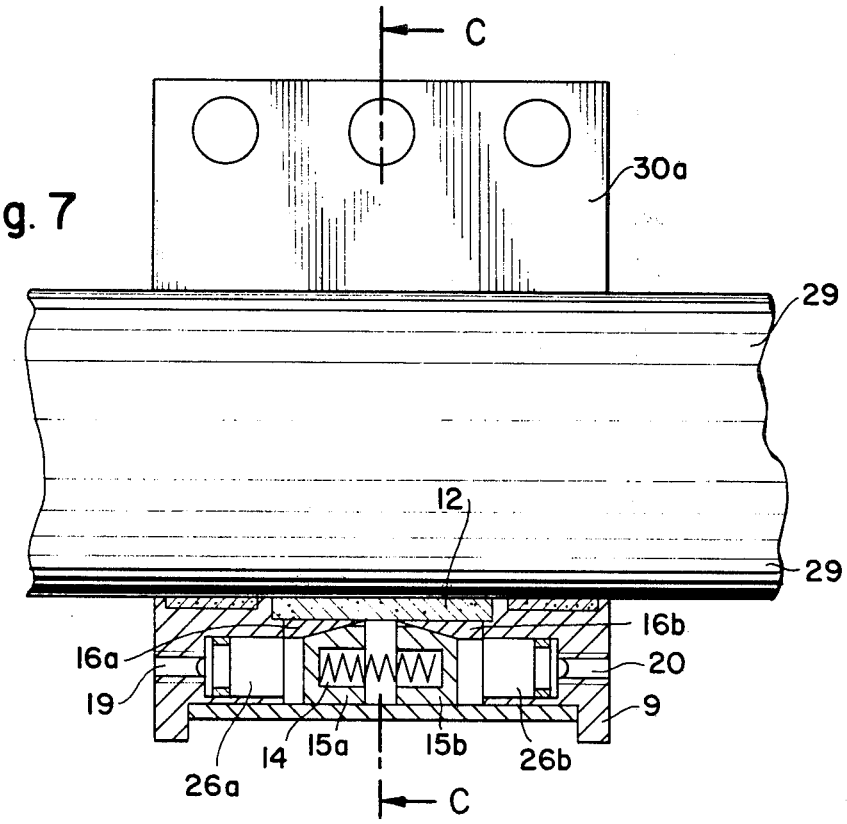
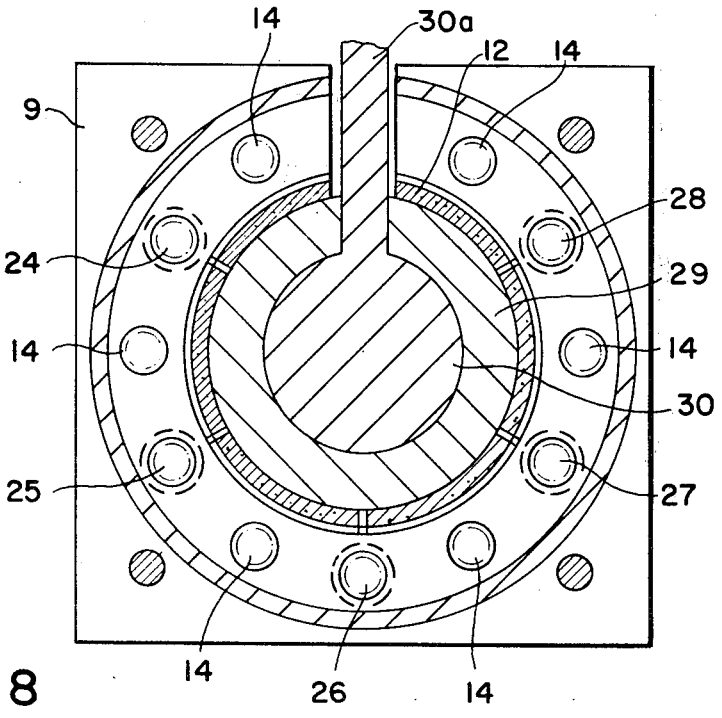
Fig. 8

BRAKE ASSEMBLY FOR FLUID OPERATED PISTON AND CYLINDER DEVICE

This invention relates to a brake assembly for the stopping, locking and positioning of a fluid operated piston and cylinder device. The device having a cable, band or the like connected to both sides of the piston and a crosshead for applying the force of a magnet or other means acting as take up mechanism, instead of a piston rod, whereby the brake assembly is operated by means of a fluid, a spring or the like.

It is well known that drives such as linear motors and fluid operated piston and cylinder devices etc. must be lockable to meet a multitude of ranges of application. Locking a fluid operated piston and cylinder device using a compressable fluid such as a gas as the driving element, is, in practice, relatively difficult, especially if changes of load take place.

It is prior art with respect to a lock mechanism of a pneumatic-operated linear motor with a piston rod to mount a brake assembly rigidly on the cylinder head. Such a brake assembly generally consists of an aluminum housing mounted on the cylinder head, an eccentric with a clutching gear and a single or double acting pneumatic operated cylinder. The piston rod of the linear motor is guided by the eccentric. The housing is fitted with a slide bearing for the piston rod.

Pressure controlled acting emergency brake assemblies are also known that are furnished with a spring element entering its working position after a decrease of pressure in the cylinder.

As far as linear motors are concerned, for example fluid operated piston and cylinder devices having an endless flexible band or cable connected to both sides of the piston and the crosshead for applying the force, the brake assembly cannot be applied because no piston rod is available. The known brake assemblies cannot be changed in such a way that it acts as a brake by being movably mounted for example on the outside of the cylinder.

In the above case, a brake assembly is mounted rigidly on the cylinder of such a linear motor, and the flexible cable or band must be locked. It is an element which is per se very difficult to be controlled. Thus the brake assembly should move as the band, cable or other power transmission and the brake assembly should be supported by the cylinder.

There has been proposed an emergency self-locking brake assembly for fluid operated linear motors supported by the inner surface of the cylinder. Such a brake assembly is disadvantageous because the inner surface of the cylinder can be damaged by the brake rolls being pressed against this surface. Another drawback of this type of brake assembly is that its capability for emergency purposes is only when working parallel to the gravitational force as for example for drop-windows etc. This type of brake assembly is not suitable as a brake of positioner for fluid operated piston and cylinder devices having a flexible member such as a band, cable etc. or power transmission instead of a cylinder rod.

It is an object of the invention to provide a brake assembly for stopping, locking and positioning a fluid operated piston and cylinder device having a cable, band, movable magnet etc. as the power transmitting member arranged in a practical manner which requires a minimum of space and which avoids the drawbacks of the well known brake devices.

According to the invention the brake assembly is part of the cross head of the linear motor and is concentrically arranged with at least one brake lining around the cylinder of the linear motor.

It is a further feature of the invention that the brake assembly consists of a bellow in which a fluid can be injected; the bellow being concentrically arranged around the cylinder and acting as a control member for the brake lining.

Advantageously the brake assembly may contain one or more fluid operated pistons controlling the brake linings via a cone and being kept in their starting position by means of a spring.

Thus, by means of this—i.e. integrating the brake assembly into the crosshead and arranging at least one brake lining circumferential to the cylinder—no overstress of the power transmitting member, the cable, band etc. can take place, even if the total brake energy available is applied. Furthermore, the brake assembly proposed by the invention is in so far universally applicable as it can be used with various fluid operated piston and the cylinder devices respectively linear motors.

It is even possible by means of the invention to control the so called load limit case, i.e. where the slowing down exceeds the power of the power unit, especially the power transmitting members can bear. The brake force available may even be higher than the driving power of the power unit, in which case the brake assembly then works absolutely independent of the fluid pressure in the cylinder. It is also of an advantage that the brake lining does not effect the inner (i.e. the bearing) surface of the cylinder which has to be kept absolutely free of any foreign matter.

Another advantage of the brake assembly according to the invention is, that besides having a suitable brake assembly for stopping and positioning a linear motor, the problem of having a safety appliance for such devices, affecting the drive unit itself (—for example if the pressure within the fluid system decreases—) has also been solved, whether the cylinder is in upright position or not.

For the purposes of this invention it is to be understood that the term "a fluid operated piston and cylinder device" is a drive unit such as a linear motor, without a piston rod where the load is supported outside the cylinder either by an endless transmission as a band, cable or the like or by means of a magnet or any other take up mechanism carrying the load, for example, a slot in the cylinder wall.

The objects and advantages of the invention will appear from the following description of a preferred embodiment of the invention.

In the drawing:

FIGS. 5, 6 and 7 are further embodiments of the invention; and,

FIG. 8 is a cross-sectional view of FIG. 7 taken along line C—C.

Figure 1:
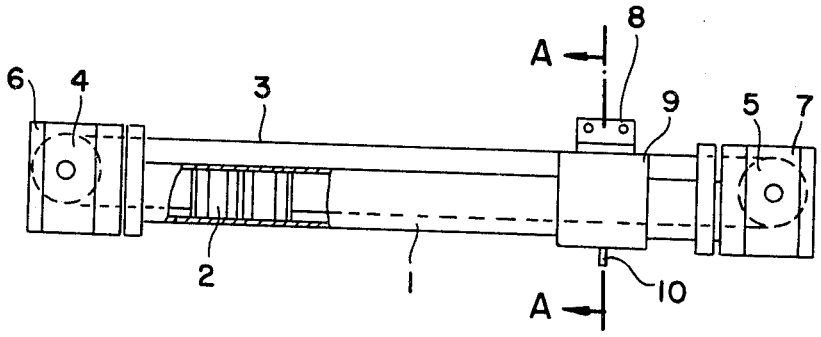
FIG. 1 is a side view of a device in accordance with the invention.

Referring now to FIG. 1 of the drawings there is shown a fluid operated piston and cylinder device fitted with the brake assembly according to the invention. The device comprises the cylinder 1 with its piston 2 and a flexible power transmitting member such as a steel band 3. The steel band 3 is fixed on both sides of the piston 2. Of course the steel band can also be a continuous unbroken portion which penetrates the piston 2 being secured to this piston and guided by pulleys 4 and 5, located in the cylinder heads 6 and 7 respectively. The crosshead 8 is outside the cylinder connected with steel band 3. The brake assembly 9 is integrated within this crosshead 8, i.e. it is part of the crosshead. A connecting pipe 10 is provided for the fluid supply into the brake assembly.

The piston 2 moves by means of the injection of a fluid moving by way of example from left to right. As a result the crosshead moves by means of the power transmitting element, the band 3 along the cylinder accordingly from right to left.

If the crosshead 8 has on its way a long cylinder to be stopped, a fluid is pressed through a connecting pipe 10 into the brake assembly 9 by means of which the bellow 11 is expanded and so actuates the brake linings 12 which are pressed against the surface of the cylinder 1. Thus the crosshead is stopped as viewed in FIGS. 1 and 2. After venting the bellow 11, the piston 2 and the load take up mechanism, the crosshead 8 can be moved forward and rearward, respectively to the left and right.

If the crosshead 8 has to be stopped along its way on the outside of the cylinder 2, fluid is injected into the brake assembly 9 through the connecting tube 10. The the bellow 11 is thus expanded actuating the brake linings 12 which are pressed against the outside of the cylinder 1, thus stopping the load take up mechanism the crosshead 8. After venting the bellow 11, the crosshead 8 and the piston 2 are movable again. The brake assembly 9 slides on a guide (not shown in the drawings) on the cylinder. Instead of a guide other already well known slide or guide arrangements can be used.

Figure 3:
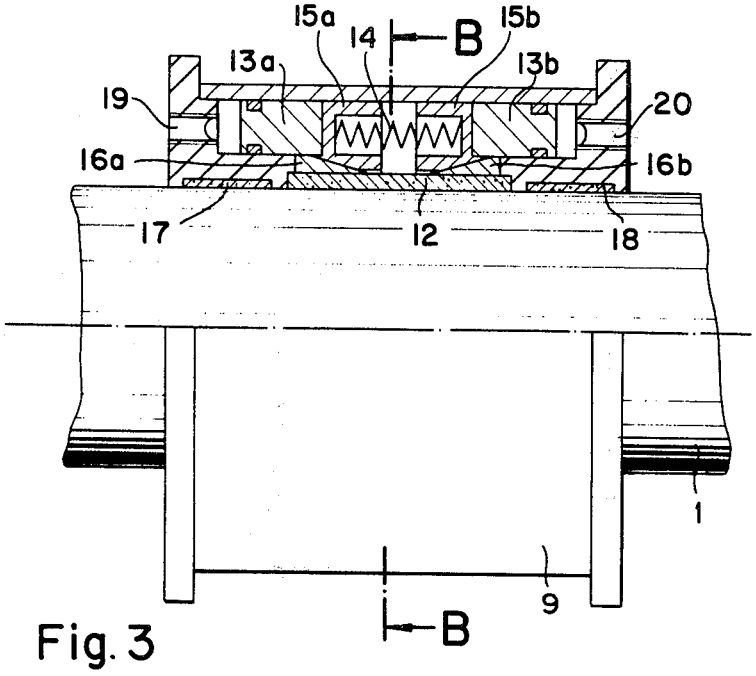
FIG. 3 is another preferred embodiment of the invention.

FIG. 3 shows another preferred embodiment of the brake assembly. Instead of a bellow 11, two annular pistons 13*a* and 13*b* are provided. Both annular pistons 13*a* and 13*b* are by means of a spring 14 pressed one against the other and pressed in their starting position. The annular pistons 13*a* and 13*b* act through transmitting members 15*a* and 15*b* having a conic bearing surface and further through counterformed members 16*a* and 16*b* onto the braking element consisting of one or more brake linings 12.

The brake assembly 9 slides on a surface of the cylinder 1 by means of glide bands 17 and 18. The fluid is injected into the brake assembly itself through connecting tubes 19 and 20.

As shown in FIG. 3, as the braking element rests in its starting position, the fluid presses the annular pistons 13*a* and 13*b* against the resiliency of the spring 14 toward the center of the brake assembly. As a result, the cones 16*a* and 16*b* are not engaged. As soon as the pressure of the fluid onto the annular pistons 13*a* and 13*b* decreases the spring 14 presses the annular pistons 13*a* and 13*b* through their members 15*a* and 15*b* into their working position and the brake lining 12 is pressed against the surface of the cylinder 1, thus stopping the crosshead 8 and piston 2 respectively.

Figure 4:
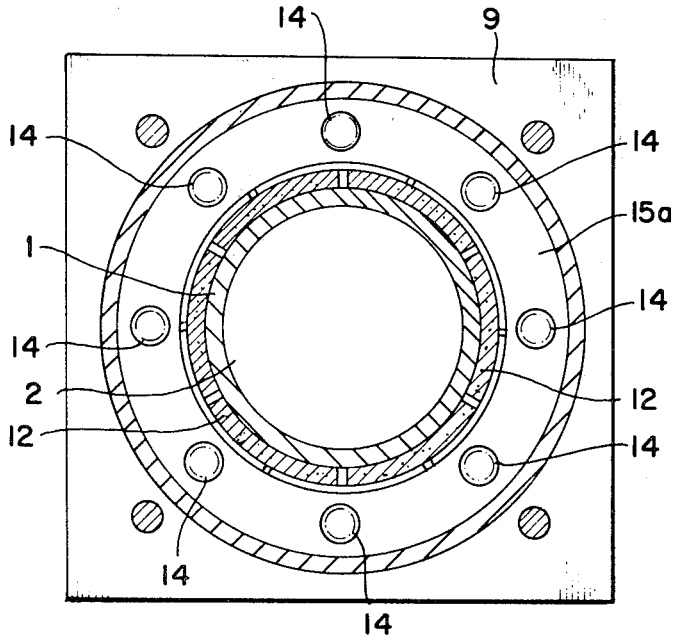
FIG. 4 is a cross-sectional view of FIG. 3 taken along lines B—B.

FIG. 4 shows a cross-sectional view of the brake assembly shown in FIG. 3. From both FIGS. 3 and 4 there can be seen that the brake assembly 9 is provided to arrest the crosshead 8 at a determined place and to neutralize this positioning at the moment of injecting a fluid into the brake assembly onto the annular pistons 13*a* and 13*b* through the connecting tubes 19 and 20. Thereafter the piston 2 and the crosshead 8 are movable again as long as the brake assembly 9 is not vented through the connecting tubes 19 and 20.

Figure 5:
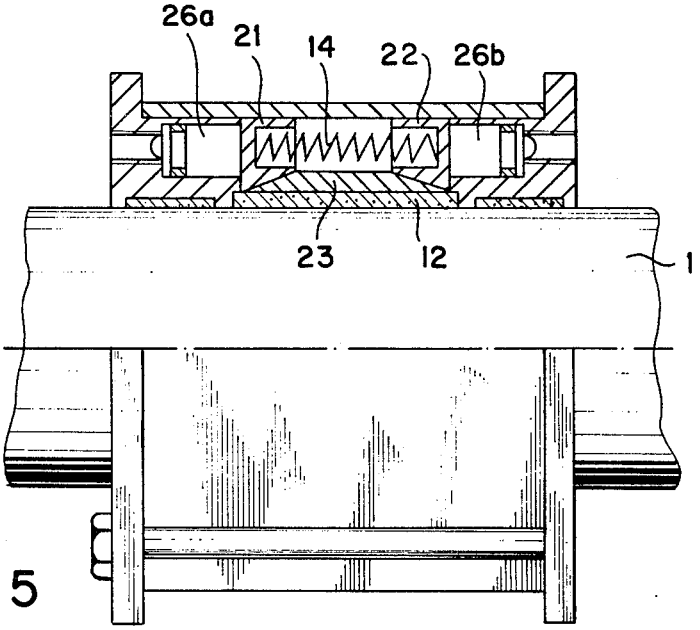

FIG. 5 shows a longitudinal sectional view of another modification of the invention with one or more pistons 26*a* and 26*b* instead of the annular pistons 13*a* and 13*b* of the brake assembly. Pistons 26*a* and 26*b* are, if more of them are provided, arranged on a concentric line around the cylinder.

Figure 2:
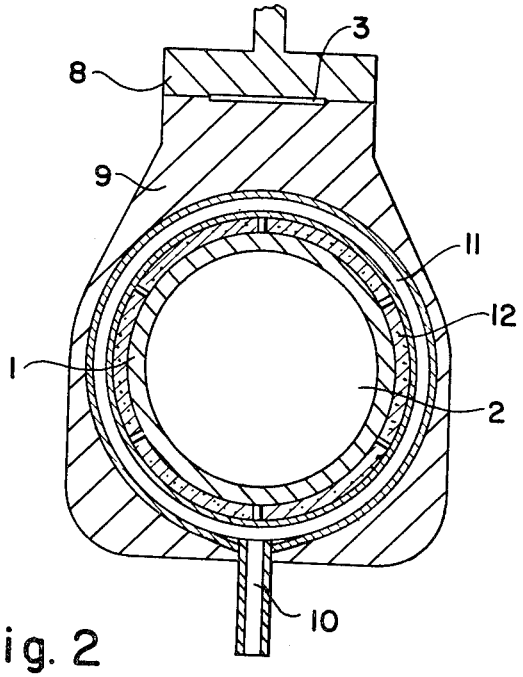
FIG. 2 is a cross-sectional view of FIG. 1 taken along lines A—A.
Figure 6:
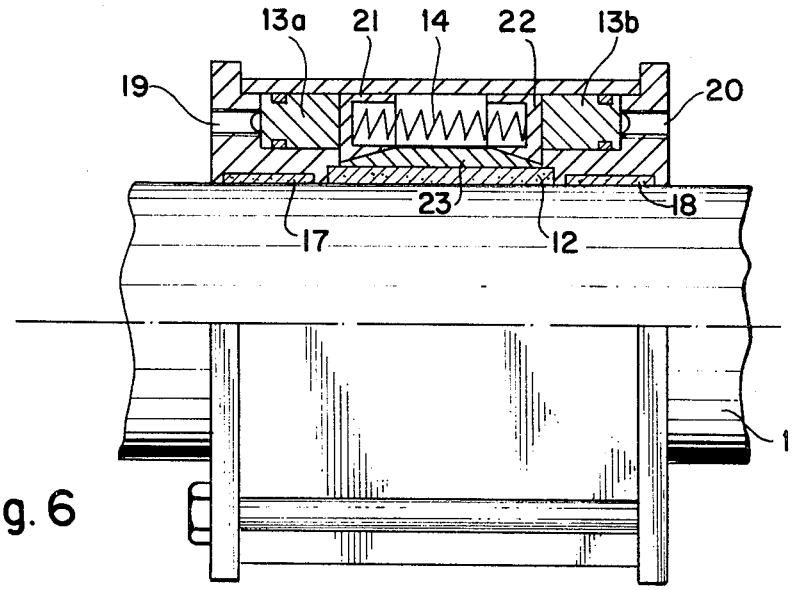

The modification of the invention shown in FIG. 6 acts in the opposite way as is described in FIGS. 3 and 4, that means in accordance with the embodiment shown in FIG. 2. Both annular pistons 13*a* and 13*b* are held in their starting position by means of the spring 14, but the conic member (15*a* and 15*b* of FIGS. 3 and 4), is replaced with transmitting member 21 and 22, acting on a countermember 23, but in the opposite way. As soon as a fluid is pressed onto the annular pistons 13*a* 13*b*, the transmitting members 21 and 22 are pressed against the conic surface of the countermember 23 and thus pressing the brake linings 12 onto the surface of the cylinder, so that the crosshead 8 is stopped.

The modification of the invention shown in FIGS. 7 and 8 illustrates that instead of the annular pistons 13*a* and 13*b* single pistons 24, 25, 26, 27 and 28 are provided, the two of them acting together. FIG. 7 shows that the transmitting members are pressed by spring tension onto the cone, i.e. the countermembers 16*a* and 16*b*. The brake lining 12 is engaged when no fluid pressure is applied on the piston 26*a* and 26*b*.

The FIGS. 7 and 8 illustrate clearly that the brake assembly provided with the invention is for general use. The drive unit as shown in both figures, consists of a sloted cylinder 29 and a piston 30 movable therein. The piston 30 and the crosshead 30*a* are one part.

A brake assembly actuated by means of an electro magnet is another possibility of modifying the subject matter of the invention (not shown). This modification uses an electro magnetic force instead of a fluid to press the piston 13*a*, 13*b* or 26*a*, 26*b* against the brake lining 12.

The brake assembly provided is in its function independent on the conditions within the drive unit of the cylinder 1 and piston 2.

The description herein does not limit the structure of this invention which may be incorporated in other physical embodiments without departing from the spirit in scope of the invention claimed.

What we claim is:

1. A brake assembly for a fluid operated piston and cylinder device of the type wherein drive means are connected to the piston to longitudinally move the piston relative to the cylinder, said piston having no piston rod, said device further having a force applying cross head movably disposed on the cylinder's outer wall surface and connected to said drive means for longitudinal movement with the piston, said assembly being integrated within the cross head and comprising at least one brake lining concentrically arranged about the cylinder for engagement with the outer wall surface of the cylinder and means for urging said brake lining into engagement with the cylinder's outer wall surface whereby to stop, lock and/or longitudinally position the piston with the cylinder.

2. The brake assembly in accordance with claim 1 wherein said urging means comprises a bellows concentrically arranged about the cylinder in engagement with said brake lining and means for introducing fluid into said bellows whereby to expand said bellows to urge said brake lining against its cylinder.

3. The brake assembly in accordance with claim 1 wherein said brake assembly consists of one or more fluid operated pistons, a cone interposed between said pistons and said brake lining, and spring means uring said pistons to go away from said brake linings when said pistons are not operated.

4. The brake assembly in accordance with claim 3 wherein said brake lining controlling pistons are disposed concentrically about said cylinder.

5. The brake assembly in accordance with claim 3 wherein said brake lining controlling pistons comprise a multiplicity of single pistons arranged concentrically about said cylinder.

6. The brake assembly in accordance with claim 1 wherein said urging means comprises an electromagnetic member.

7. The invention in accordance with claim 1 wherein said device includes a guide on the outside of said cylinder and said brake assembly slides on said guide.

8. The brake assembly in accordance with claim 1 wherein the cross head is connected to the piston through a slot in the cylinder wall so that it is a part of said piston.

9. The brake assembly in accordance with claim 1 wherein the drive means comprises a power transmission member connected to both sides of the piston.

10. The brake assembly in accordance with claim 9 wherein the power transmission member is a steel band.

* * * * *